US006485566B1

(12) United States Patent
Christian et al.

(10) Patent No.: US 6,485,566 B1
(45) Date of Patent: Nov. 26, 2002

(54) METHOD AND APPARATUS FOR PREWETTING YARN

(75) Inventors: Charles R. Christian, LaFayette, AL (US); Harold E. Cook, Lanett, AL (US)

(73) Assignee: West Point Foundry & Machine Company, West Point, GA (US)

( * ) Notice: Subject to any disclaimer, the term of this patent is extended or adjusted under 35 U.S.C. 154(b) by 47 days.

(21) Appl. No.: 09/778,536

(22) Filed: Feb. 7, 2001

(51) Int. Cl.[7] ..... B05C 5/00; B05C 11/00; D06M 11/00

(52) U.S. Cl. ..... 118/67; 118/314; 118/325; 28/178; 226/104

(58) Field of Search ..... 118/66, 67, 699, 118/315, 325, 313, 314, 33, 32; 28/166, 167, 178, 271, 283; 226/104

(56) References Cited

U.S. PATENT DOCUMENTS 2,778,763 A * 1/1957 Novak ..... 57/249
3,235,932 A * 2/1966 Jones ..... 118/33
4,110,824 A * 8/1978 Halsey et al. ..... 364/472
6,395,041 B1 * 5/2002 Voswinckel ..... 8/115.6

* cited by examiner

*Primary Examiner*—Richard Crispino
*Assistant Examiner*—Yewebdar T Tadesse
(74) *Attorney, Agent, or Firm*—Kilpatrick Stockton LLP

(57) ABSTRACT

Prewetting yarn by applying a liquid spray to the yarn before applying size to the yarn. A yarn sheet comprising a plurality of yarns is moved past one or more sprayers for directing a spray of prewetting liquid to the surface of the yarn. The amount of prewetting liquid sprayed onto the yarn is determined by various yarn parameters, and is adjusted in response to the speed of the moving yarn sheet so that variations in speed do not affect the amount of prewetting liquid sprayed onto the yarn. The amount of time elapsing between spraying the yarn with prewetting liquid and applying size to the yarn may be varied, to adjust the time for the prewetting spray to penetrate the yarn.

4 Claims, 1 Drawing Sheet

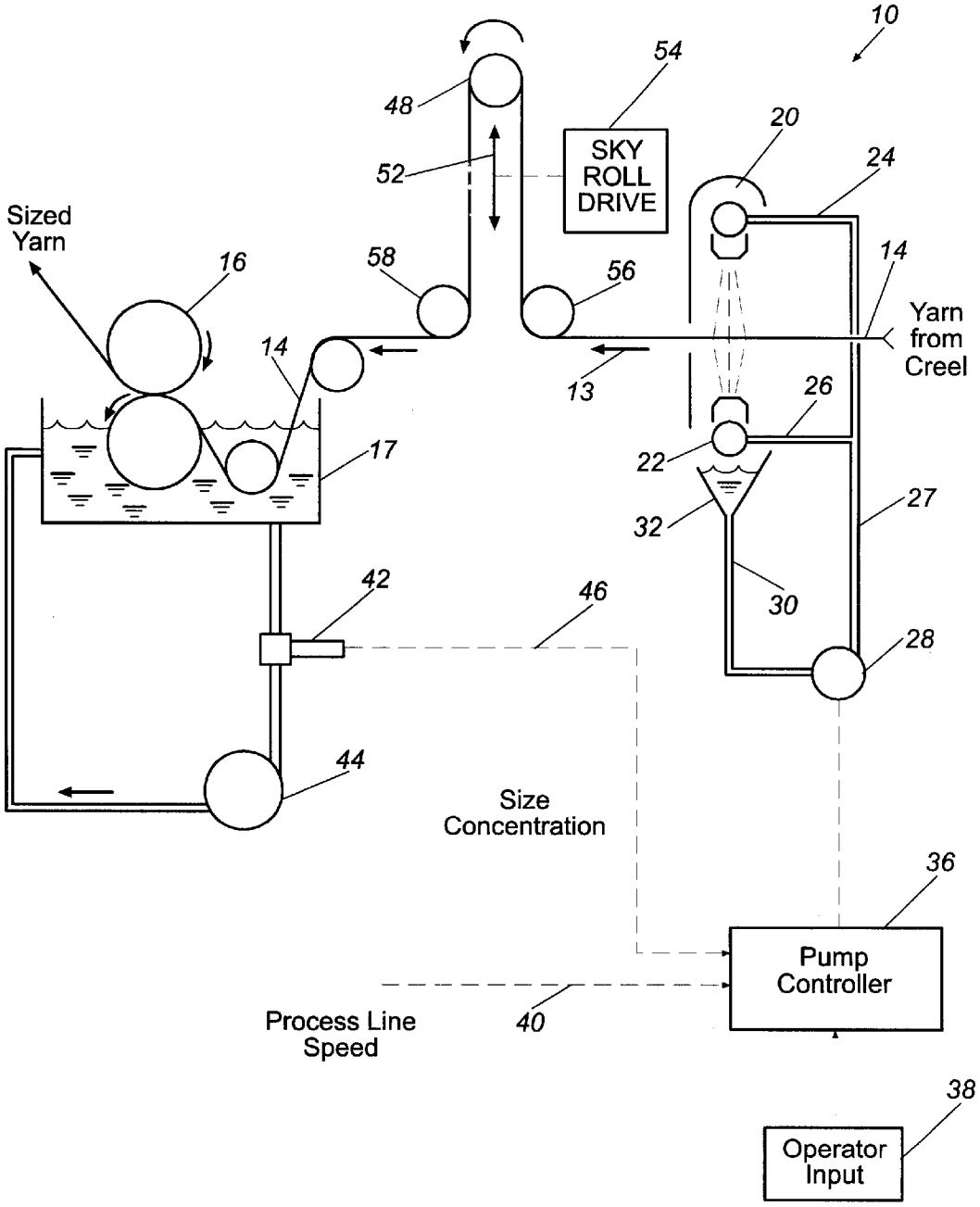
10
54
48
20
SKY
ROLL
DRIVE
24
52
Sized
Yarn
16
58
56
14
Yarn
from
Creel
14
13
26
17
22
27
32
42
46
30
28
44
Size
Concentration
36
Pump
Controller
Process Line
Speed
40
38
Operator
Input

METHOD AND APPARATUS FOR PREWETTING YARN

FIELD OF THE INVENTION

This invention relates in general to sizing textile yarns, and relates in particular to an improved method and apparatus for prewetting yarns by applying a liquid spray to the yarn.

BACKGROUND OF THE INVENTION

Size is applied to yarn to improve properties of the yarn prior to a weaving process. The primary properties of yarn improved by sizing are hairiness, breaking strength, resistance to abrasion, and lubrication. Sizing material typically consists of natural starches, synthetic polymers, and blends of the two with minor ingredients added.

It is known in the art that the sizing process for many types of yarn can be improved by wetting the yarn, e.g., with water, before applying size to the yarn. Prewetting the yarn removes oils and waxes from the yarn resulting in improved pickup of size when the yarn sheet, comprising a number of yarns aligned in substantially parallel relation, subsequently passes to a size bath in a vat known as a size box. The prewetting liquid also fills the central core of the yarn, displacing size that would otherwise fill the core in the subsequent application of size, so that the size is instead applied mainly to the surface of the yarn. Prewetting the yarn before applying size thus yields a significant reduction in the amount of sizing material required to size the yarn, and may also result in improved weaveability of the sized yarn. The nature of sizing processes and the resulting benefits are well known to those skilled in the art.

Yarn prewetting according to the prior art takes place by immersing the moving sheet of yarns in a prewet immersion box and then removing excess water by passing the yarn sheet through a squeeze roller assembly. The prewet immersion box and squeeze roller assembly are located a short distance upstream from the size box, so that the prewetted yarn sheet enters the size box after leaving the squeeze roller assembly. There the yarn sheet is immersed in a size bath and excess size is removed by a separate squeeze roller assembly. The construction and operation of such Prewetting apparatus and sizing apparatus are well-known in the art and need not be further detailed herein.

SUMMARY OF THE INVENTION

Stated in general terms, prewetting according to the present invention is accomplished by replacing the traditional immersion box-squeeze roll applicator with one or more liquid spray nozzles wetting the yarn prior to entry into the size applicator. The rate of prewet liquid applied to the yarn is determined by the rate of liquid flow through the spray nozzle. Retention of liquid sprayed onto the yarn may be enhanced by increasing the dwell time of the moving yarn between the prewet spray and immersion of the yarn in the size solution, so as to adjust the extent to which the Prewetting liquid penetrates the yarn before the size is applied.

Stated in somewhat greater detail, the amount of dwell time between applying the liquid spray and immersing the yarn in the size solution is adjusted, without increasing or reducing the forward speed of the yarn, by increasing or decreasing the distance between the liquid spray application and the immersion of the yarn in the size solution. In particular detail, this selective variation in distance is accomplished by passing the prewetted yarn over an adjustable roll, known as a sky roll, positioned on the yarn path between the prewet spray applicator and the size applicator. Moving the position of the sky roll thus increases or decreases that path, producing a corresponding change in the dwell time of the prewet yarn of the yarn speed itself.

The amount of liquid spray applied to the moving yarn may be adjusted without changing the forward speed of the yarn sheet. This adjustment allows applying a substantially constant predetermined amount of prewet liquid to the yarn, irrespective of changes in the forward speed of movement of the yarn through the prewet spray and the subsequent size applicator. In this manner, yarn prewetting can be preset by an operator, based on various parameters such as yarn size, the number of strands, and the amount of water pickup desired, and the amount of liquid spray applied to the moving yarn is thereafter automatically maintained independent of subsequent increases or decreases in the speed of the moving yarn sheet.

The amount of liquid spray being applied to the yarn may also be adjusted in response to the concentration of liquid size being applied to the prewetted yarn. This adjustment may be manual, or may be automated in response to the size concentration.

Accordingly, it is an object of the present invention to provide an improved method and apparatus for prewetting yarn.

It is another object of the present invention to provide an improved method and apparatus for prewetting yarn prior to applying size to the yarn.

It is a further object of the present invention to provide a method and apparatus for prewetting yarn without immersing the yarn in liquid.

It is still another object of the present invention to provide a method and apparatus for prewetting yarn with a substantially constant predetermined amount of liquid while varying the throughput of the yarn.

It is still a further object of the present invention to provide an improved method and apparatus for prewetting yarn to a selectively variable extent independently of throughput speed of the yarn.

The foregoing and other objects and advantages of the present invention will become more readily apparent from the following description of a preferred embodiment.

BRIEF DESCRIPTION OF DRAWINGS

The FIGURE is a schematic view of a yarn prewetting apparatus according to a preferred embodiment of the present invention.

DETAILED DESCRIPTION OF PREFERRED EMBODIMENT

Prewetting apparatus according to the present invention is shown generally at 10 and is located adjacent a sizing apparatus shown generally at 12. A yarn sheet 14 moves serially through the prewet apparatus 10 and the sizing apparatus 12, and it will be understood that a typical yarn sheet comprises a plurality of individual yarn aligned side by side on a planar path. The yarns comprising the yarn sheet 14 may be drawn from a creel located upstream from the prewet apparatus 10 and not shown on the drawing. The yarn sheet 14 is serially moved through the prewet apparatus 10 and around the immersion roll 15 in the size box 17 of the sizing apparatus 12, in the direction shown by the arrows 13.

After exiting the squeeze roller assembly 16 above the size box 17, the sized yarn sheet is dried and then wound to form a warp beam, as is known to those skilled in the art The prewet assembly 10 in the present embodiment applies a spray of liquid directed toward the upper and lower sides of the yarn sheet 14. This liquid spray flows from an upper nozzle assembly 20 located above the yarn sheet 14, and from a lower nozzle assembly 22 located below the yarn sheet in approximate opposition to the upper nozzle assembly. In an actual prototype of the disclosed embodiment, there are eight nozzles on each of the upper and lower nozzle assemblies, although the number of such nozzles is not considered critical. Each nozzle is mounted on a pivot which allows directional changes of the spray as necessary to provide uniform coverage of the liquid spray across the width of the yarn sheet 14 moving between the nozzle assemblies. It is envisioned that the nozzles may be positioned to direct the liquid spray rearwardly, that is, toward the incoming yarn, so as to lay back the fibers of the yarns without brushing or other mechanical contact with the yarns, as is required in the prior art. It is also contemplated that a single sprayer may be used instead of multiple nozzles.

The nozzle assemblies 20 and 22 are supplied with prewetting liquid through the lines 24 and 26, which in turn are connected through the line 27 to the output side of a liquid pump 28. The inlet side of the pump 28 is connected through a line 30 to the liquid supply and sump 32, preferably located below the spray nozzle assemblies 20 and 22 so as to collect overspray or liquid droplets that do not remain on the yarn sheet. It will be understood that the sump 32 may receive liquid through a supply including an automatic level control to replenish the prewetting liquid as required during operation of the prewet apparatus.

Water is the usual liquid applied through the spray nozzles to the yarn sheet. A suitable wetting agent may be mixed with the water to improve the wetability of the spray applied to the yarns. However, it should be understood that the present invention is not limited to the use of water or a water-based spray for the prewetting liquid.

The rate at which the spray of prewetting liquid is directed toward the yarn sheet 14 is directly proportional to the flow rate of prewetting liquid delivered to the nozzle assemblies 20 and 22 by the pump 28. That pump is operated by the pump controller 36 receiving operator inputs as shown at 38. The pump controller 36 preferably operates to determine the percentage by weight of prewetting liquid to be added to the yarn in response to selected parameters inputted by the operator, and to drive the pump 28 so as to deliver an appropriate flow of prewetting liquid to the yarn sheet to achieve that amount of prewetting. The selected yarn parameters are entered to the pump controller by the operator, and these parameters include the percent water by weight to be applied, the diameter and weight of the fibers, and the number of strands in the web. The preferred amounts of prewetting liquid per unit of yarn is determined by such parameters in a manner known to those skilled in the art.

The pump controller 36 also receives an input signal along line 40, corresponding to the linear speed at which the yarn sheet 14 is moving forward through the prewet apparatus 10 and the sizing apparatus 12. This process speed of the moving yarn sheet is determined by operation of the winding apparatus (not shown) and the squeeze rolls 16 associated with the sizing apparatus. The speed-related signal supplied on the line 40 to the pump controller 36 preferably is derived from the operating set point of those yarn driving devices, or from a tachometer or other apparatus measuring the linear speed of the yarn sheet.

The pump controller 36 operates to vary the speed of the pump 28 in response to the input signal on the line 40, corresponding to the speed of the yarn sheet 14, so as to deliver the volume of liquid spray preferred for the particular yarn parameters input at 38 by the operator. The amount of prewetting liquid spray directed to the moving yarn sheet per unit length of yarn thus remains constant, at a rate determined by the makeup of the yarns, as the absolute amount of prewetting liquid is varied in response to production speeds of the moving yarn sheet.

The amount of prewetting liquid spray delivered to the yarn sheet may also be adjusted in response to other parameters. For example, if the batch of size in the size box 17 contains more than a predetermined amount of size solids by weight, the spray prewet apparatus 10 can apply a larger percentage of water to the yarns so as to obtain the desired percentage of solids carried by the yarn leaving the size box. The amount of prewet liquid spray would be reduced to maintain the desired solids percentage for a weaker-than-standard batch of size in the size box 17. This optional size-related control of the prewetting operation is obtained by measuring the percentage of solids in the size solution with a concentration sensor 42 located in the size recirculation loop 44 associated with the size box 17 and producing a signal corresponding to the sensed concentration, and supplying that signal along the line 46 as an additional input to the pump controller 36. The nature and operation of size recirculation loops and concentration sensors are known to those skilled in the art and are described, for example, in co-pending U.S. patent application Ser. No. 09/321,333 assigned in common with the present application. The pump controller 36 operates in response to the concentration-related input from the detector 42 to adjust the delivery of prewetting liquid spray, for a particular process line speed and inputted yarn parameters, to increase or reduce liquid delivery by the pump 28 as appropriate to compensate for an overly-rich or overly-lean concentration of solids in the size solution to which the moving yarn sheet 14 is headed.

Penetration of the applied prewetting spray into the yarn is related to the dwell time between application of the liquid spray and application of size in the size box 17. Increasing the dwell time generally results in increased or deeper penetration of the prewetting liquid spray into the yarns, which in turn should result in more efficient uptake of the size solution by the yarn. This dwell time is selectably adjusted according to the preferred embodiment by passing the moving to prewetted yarn sheet over a sky roll 48 interposed in the yarn path moving from the prewet apparatus 10 to the sizing apparatus 12. The sky roll 48 is mounted above the generally-horizontal path of the yarn sheet 14 through the prewet apparatus 10, in the preferred embodiment, and is selectably movable along a vertical path as indicated by the bi-directional arrow 52. The location of the sky roll 48 on the path 52 is determined by the sky roll drive 54, operatively connected to raise or lower the sky roll in relation to the idler rolls 56 and 58 disposed on the nominal horizontal path of the yarn sheet 14 exiting the prewet apparatus 10. The sky roll 48 may traverse a vertical path as indicated by the arrow 52, or alternatively may traverse an arcuate path having a substantial extent of movement in the vertical direction or otherwise so as to lengthen or shorten the distance traveled by the yarn sheet between the prewet apparatus 10 and the sizing apparatus 12. The dwell time of the prewetted yarn at any given speed of the yarn sheet, and thus the extent to which the prewetting liquid penetrates the yarn at that speed, thus is determined by the position of the sky roll 48.

The selected position of the sky roll 48 by the drive 54 may be manual, that is, by direct operator control of the positioner 54. Optionally, the position of the sky roll may be automatically controlled, for example, in response to the linear speed of the moving yarn sheet. Other variables being equal, the sky roll 48 would be selectably positioned to increase the overall length of the yarn path as the speed of the yarn sheet increases, thereby maintaining a predetermined amount of dwell time for the prewetting liquid notwithstanding the increase in speed.

It should be understood that the foregoing relates only to a preferred embodiment of the present invention, and that numerous changes and modifications therein may be made without departing from the spirit and scope of the invention as defined in the following claims.

What is claimed is:

1. Apparatus for prewetting yarn moving along a path including a location for applying size to the yarn, comprising:

at least one sprayer operative to direct a liquid spray toward the yarn before the yarn arrives at the sizing location, so as to wet the yarn; and means operatively associated with the yarn on the path to selectively adjust the amount of time elapsing before the wetted yarn arrives at the location for applying size, so as to adjust the extent to which the sprayed liquid penetrates the yarn before the size is applied.

2. The apparatus as in claim 1, wherein:

the means is selectably operative to vary the length of the path traveled by the prewetted yarn sheet while moving to the sizing location.

3. The apparatus as in claim 1, wherein the yarn is moved at a selectably variable speed along the path, and further comprising:

means for adjusting the liquid spray in proportion to the speed of the yarn so as to apply substantially a predetermined amount of liquid spray to the yarn irrespective of variations in the speed of movement of the yarn.

4. The apparatus as in claim 3, wherein:

the means for adjusting the elapsed time comprises means operative to vary the length of the path traveled by the wetted yarn before reaching the sizing location.

* * * * *